United States Patent [19]

Steele et al.

[11] 4,128,348

[45] Dec. 5, 1978

[54] METHOD AND APPARATUS FOR APPLYING INK TO RIBBONS

[75] Inventors: Bazil E. Steele, Rockville; Paul O. Micheel, Ellicott City, both of Md.

[73] Assignee: Steele Associates, Inc., Rockville, Md.

[21] Appl. No.: 704,320

[22] Filed: Jul. 12, 1976

[30] Foreign Application Priority Data

Jul. 14, 1975 [GB] United Kingdom ..... 29469/75

[51] Int. Cl.[2] ..... B41F 31/14

[52] U.S. Cl. ..... 400/198; 400/200; 427/285; 427/141; 118/60

[58] Field of Search ..... 118/60, 264; 197/171, 197/180, 150; 427/141, 285

[56] References Cited

U.S. PATENT DOCUMENTS

| | | | |
|---|---|---|---|
| 1,179,946 | 4/1916 | Lewis | 427/141 |
| 3,352,317 | 11/1967 | Dahlgren | 101/350 |
| 3,377,598 | 4/1968 | Borman | 197/171 |
| 3,625,334 | 12/1971 | Ahn | 197/171 |
| 3,694,927 | 10/1972 | Sorenson | 118/60 |
| 3,701,318 | 10/1972 | Lozean et al. | 197/133 R |
| 3,730,449 | 5/1973 | Satas et al. | 197/133 R |
| 3,731,649 | 5/1973 | Anderson et al. | 118/60 |
| 3,880,077 | 4/1975 | Glaser et al. | 101/219 |
| 4,031,853 | 6/1977 | Conrad | 118/264 |

FOREIGN PATENT DOCUMENTS

| | | | |
|---|---|---|---|
| 849034 | 9/1960 | United Kingdom | 197/171 |

*Primary Examiner*—William Pieprz
*Attorney, Agent, or Firm*—Finnegan, Henderson, Farabow & Garrett

[57] ABSTRACT

Disclosed is a method and apparatus for inking ribbons used in printing devices. Ribbon to be inked is unwound under tension from a core and passed over a heated roller and between a pair of transfer rollers. The transfer rollers lie in contact with inking rollers disposed in troughs of ink. The inking rollers have metering rollers in contact with the transfer rollers to meter a predetermined quantity of ink onto the transfer rollers. Once ink is transferred to the ribbon, the ribbon is passed over another heated roller to spread the ink and smooth the ribbon. A take-up roller winds the inked ribbon about a second core. The heated rollers on opposite sides of the transfer rollers engage opposite sides of the ribbon.

20 Claims, 3 Drawing Figures

FIG. 1
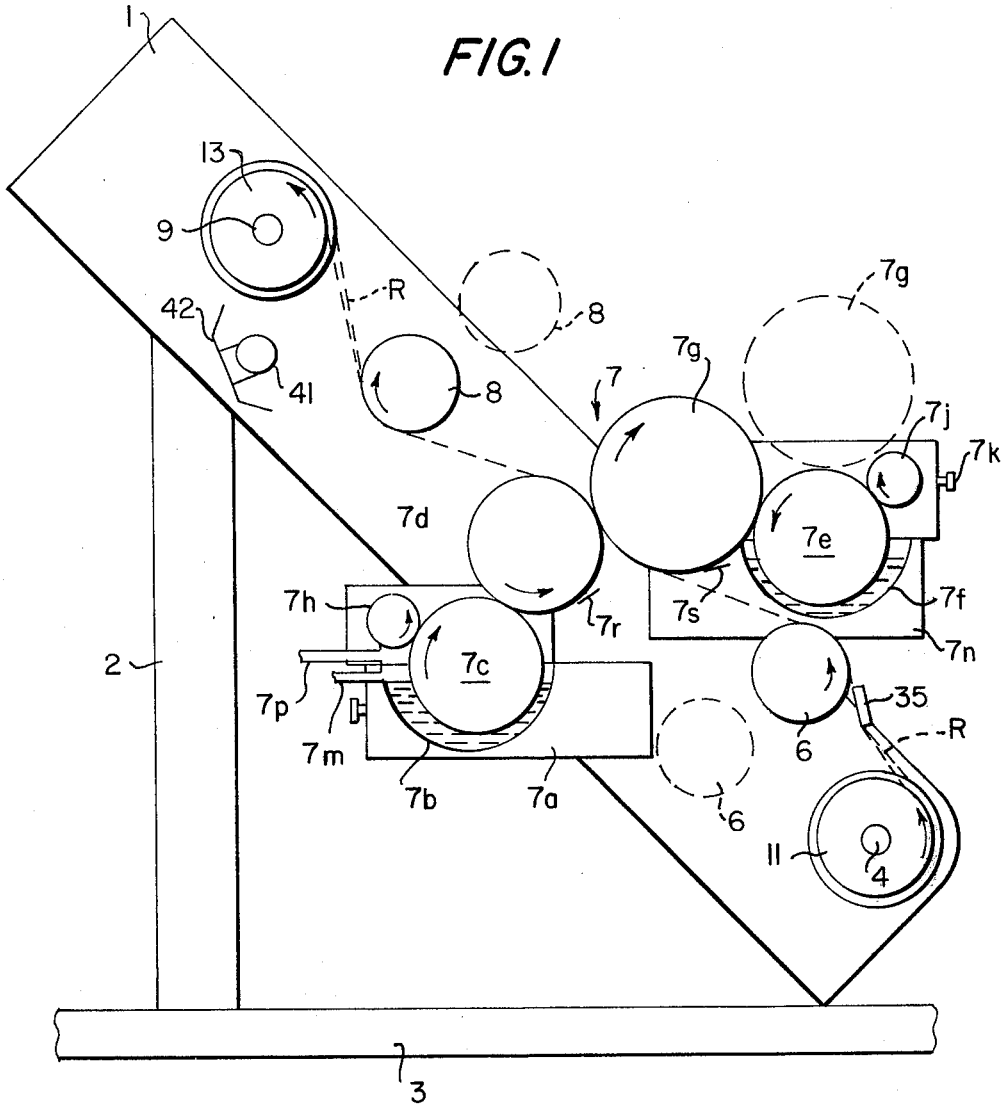
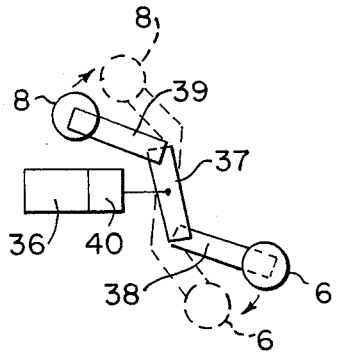
FIG. 3

METHOD AND APPARATUS FOR APPLYING INK TO RIBBONS

The present invention relates to a method and apparatus for applying ink to used inked ribbons, such as are employed in printing apparatus and more particularly in business machines and computer peripheral equipment.

In one aspect, the present invention provides a method for applying fresh ink to a used inked ribbon comprising the steps of applying heat to the ribbon to expand and unwrinkle or smooth the fibers of the ribbon, applying ink under pressure to at least one side of the ribbon to impregnate the ink into the interstices of the fibers of the ribbon and again applying heat to the ribbon to spread the ink and smooth the ribbon. Preferably, ink is applied under pressure to both sides of the ribbon.

Preferably, the ribbon is initially heated on one side by passing it under tension over a heated rotating roller thereby to flex and heat the ribbon. After the ink is applied, final heating of the ribbon is effected by applying heat to the other side of the ribbon by passing it under tension over another heated rotating roller to spread the ink and smooth the ribbon.

Advantageously, the inking of the ribbon under pressure is effected by passing the ribbon between two ink transfer rollers, each of which receives ink from a roller rotating in a trough of ink.

In another aspect of the present invention, there is provided apparatus for applying fresh ink to a used inked ribbon, including a frame, means carried by the frame for rotatably carrying a core thereby enabling the ribbon to be unwound therefrom, a first roller for applying heat to one side of the ribbon and over which the ribbon passes as it is unwound from its core, second and third rollers carried by the frame for applying ink to opposite sides of the ribbon as it passes between them after being heated by the first roller, a fourth roller carried by the frame for contacting and applying heat to the side of the ribbon opposite the one side thereof, and means for passing the ribbon over the first, second, third and fourth rollers and winding the inked ribbon on a second core.

The accompanying drawings illustrate a preferred embodiment of the present invention and, together with the description, serve to explain the principles of the invention.

IN THE DRAWINGS

FIG. 1 is a diagrammatic side elevational view of an embodiment of a re-inking machine illustrating the method of the present invention;

FIG. 3 is a diagrammatic view of a throw-off arrangement for the heated rollers.

Figure 2:
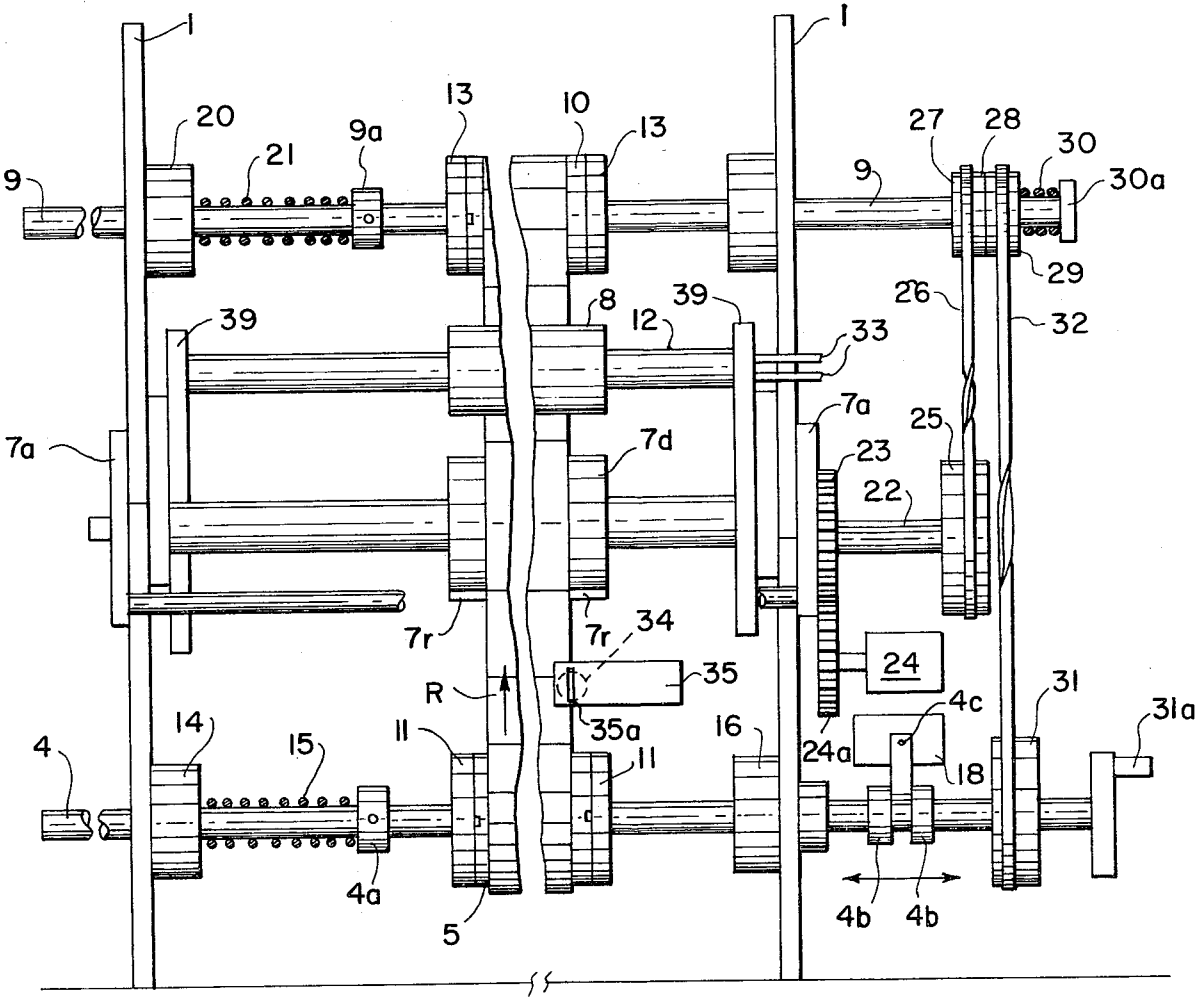
FIG. 2 is a plan view of the machine illustrated in FIG. 1 having parts (specifically the first heated roller and the upper ink roller and trough) broken out and removed for clarity.

Referring to the drawings, a machine constructed in accordance with the present invention includes a frame having two inclined parallel spaced side frame members 1 having their upper ends supported by columns 2 which rest on a base member 3. The lower ends of the side frame members 1 also rest on base member 3. Between side frame members 1 are arranged, in the direction of travel of a ribbon to be re-inked, a shaft 4 for supporting a core 5 containing a ribbon R to be re-inked, a first heated roller 6, a second heated roller 8 and a take-up shaft 9 supporting a core 10 (FIG. 2) on which the re-inked ribbon is re-wound. The rollers 6 and 8 contain electrical heating elements and electrical power is provided thereto by connections 33.

The ribbon R, to be re-inked and supported on core 5 (FIG. 2), is positioned between chucks 11 on shaft 4. Shaft 4 is thus split into two parts. Ribbon R passes from core 5 over the first heated roller 6 with its lower surface (as viewed in FIG. 1) in contact with roller 6. Ribbon R then passes through the re-inking station 7.

In accordance with the present invention, re-inking station 7 comprises two pairs of side frames *7a* and *7n*. The side frame *7a* supports an ink-containing trough *7b* in which an ink roller *7c* rotates in contact with a transfer roller *7d*. Roller *7d* applies ink to the lower side of ribbon R. A further ink roller *7a* rotates in an ink-containing trough *7f* supported by side frames *7n*. Roller *7e* applies ink to the other or upper side of the ribbon through a transfer roller *7g*. Thus, ribbon R passes under pressure through the nip between the two ink transfer rollers *7d* and *7g*. Ribbon R then passes over heated roller 8 supported on shaft 12, and is then re-wound on the take-up core 10 held by chunks 13 on shaft 9. Shaft 9 is thus split into two parts similarly as shaft 4. Shaft 12 is mounted between two parallel swing arms 39.

More specifically, ink roller *7c* rotates in ink trough *7b* in contact with a metering roller *7h* which meters the quantity of ink applied to the transfer roller *7d*. Roller *7d*, in turn, applies ink to the lower side of ribbon R. A similar arrangement including a metering roller *7j* is provided for ink roller *7e*. Ink roller *7e* contacts the transfer roller *7q* which applies ink to the upper surface of ribbon R. Ink is fed to the troughs through an input *7p* from a pump. Ink overflow from the troughs flows through a pipe *7m* to the ink reservoir which feeds the pump.

A control for metering the ink is illustrated in FIG. 1. Particularly, doctor blades *7r* and *7s* are arranged adjacent the ends of transfer rollers *7d* and *7g* to remove surplus ink from those marginal edge areas of ribbon R which have not been subject to de-inking in use and which therefore already have a substantial full content of ink.

As illustrated in FIG. 2, the left-hand part of the shaft 4, which supports the core 5 carrying the ribbon R to be re-inked, is axially slidable in a bearing block 14. A compression spring 15 is arranged around shaft 4 between bearing block 14 and a collar *4a* secured to the shaft. The right-hand part of shaft 4 extends through a bearing block 16 into a further section of the machine, generally indicated at 17, and carries two spaced collars *4b* defining a gap which receives the end of an arm *4c* mounted on the output shaft of a gear motor 18, for purposes described hereinafter. The machine section 17 also contains a drive mechanism for the various rollers, as will be described later.

In a similar manner, the left-hand part of shaft 9 is axially slidable in a bearing block 20. A compression spring 21 surrounds shaft 9 between bearing block 20 and collar *9a* attached to the shaft. The right-hand part of shaft 9 extends into drive section 17.

The axially slidable left-hand parts of the shafts 4 and 9 as illustrated in FIG. 2 enable insertion and removal of the cores 5 and 10 between the respective chucks 11 and 13.

As indicated by the dashed lines in FIG. 1, both the heated rollers 6 and 8 and the upper ink transfer roller *7g* throw off for easy threading of ribbon R and, to this end, the rollers 6 and 8 are mounted on swing arms, described hereinafter with reference to FIG. 3.

The drive section 17 of the machine comprises a drive shaft 22 which drives roller *7c* and which carries a gear 23 in mesh with a gear 24*a* driven by a main drive motor 24. A further gear train, not shown, is provided for rotating ink roller and *7e*. Shaft 22 also carries a pulley 25 and a drive belt 26 passes about pulley 25 as well as about a pulley 27 carried on the right-hand end of shaft 9. Pulley 27 forms part of a clutch mechanism including a friction disc 28 and a further pulley 29. The clutch parts are urged together by a tension spring 30 disposed about shaft 9 between pulley 29 and an adjustable end stop 30*a*. A further drive belt 32 extends from pulley 29 to a pulley 31 carried by the right-hand part of shaft 4. A manually operable rewind crank handle 31*a* is also provided on the end of shaft 4. Both of belts 26 and 32 are crossed in their path between their supporting pulleys in order to provide the desired directions of rotation to pulley 27 and 31.

In operation, motor 24 drives shaft 22 carrying roller *7c* and also rotates pulley 25 thereby driving shaft 9 through belt 26 and pulley 27 to take up ribbon R on the core 10 held between the chucks 13. As ribbon R is wound about core 10, it is unwound from core 5 and rotates the shaft 4. Simultaneously pulley 31 rotates in the opposite direction by the back drive provided by pulley 29 and crossed belt 32 to take up slack in the ribbon feeding off core 5. The amount of back drive is adjusted by varying the tension of spring 30 on the clutch 27, 28, 29 by means of an adjustable end stop 30*a*, to provide a substantially constant winding tension and to compensate for variations caused by the changing diameter of the ribbon on the core as it is transferred from core 5 to core 10.

Thus the clutch mechanism automatically controls the tension of the ribbon as it passes through the machine within a manual range of adjustment to ensure the desired tightness of ribbon R as it is wound on core 10.

Consistent with this previous disclosure, the operation of the drive and tension mechanism will be more specifically disclosed.

As is apparent from FIGS. 1 and 2, the ribbon is driven between ink transfer rollers *7d* and *7g*. Roller *7d* is, in turn, driven by ink roller *7c* (shown in FIG. 1), which is in turn driven by shaft 22. Therefore, the pulley 25, linked to ink roller *7c* through shaft 22, rotates in a direction opposite that of shaft 9. As shown in FIG. 1, shaft 9 rotates counterclockwise to collect the ribbon on the take-up core 10. Therefore, the belt connecting pulley 25 with pulley 27 is twisted as shown in FIG. 2 to reverse the direction between the two pulleys. In that manner, the drive from the motor 24, transmitted through the gear 23 to shaft 22 and pulley 25, is applied to the shaft 9, turning the take-up core 10 in a manner to exert tension on the ribbon.

The shaft 4, on which the supply core 5 is detachably affixed, is driven by the unwinding of the ribbon from the supply core. Pulley 31, affixed to the shaft 4, rotates in the same direction as shaft 9 and the take-up core 10. The pulley 31 is, however, linked to pulley 29, rotatably mounted on the shaft 9. As shown in FIG. 2, the belt linking pulley 29 and pulley 31 are twisted to reverse the direction of rotation. Therefore, the rotation of shaft 9, transmitted to the friction material 28 between pulley 27 and 29, resists the rotation of the pulley 31.

The friction between the pulleys 29 and 27 transmits the force of the rotation of shaft 9 back to shaft 4, providing the back drive previously mentioned. Similarly, the rotation of the pulley 29, in opposition to the pulley 27, decreases the force applied to the take-up core 10 through the shaft 9. The tension, being balanced by the interrelationship of these driven shafts, is automatic since the slippage between pulley 27 and pulley 29 is predetermined by the tension in the spring 30. The length of the spring 30 is manually controlled but the slippage induced by the spring, once set, is constant. The tension in the ribbon, however, is not constant due to the different forces applied to shafts 4 and 9, respectively.

The opposed rolls *7d* and *7g* drive the ribbon through the apparatus at a constant linear rate. As the supply core 5 is depleted of ribbon, its radius decreases. Therefore, its rotational speed increases. The increase in rotational speed provides an increased resisting force applied through the friction material 28 to the pulley 27. This decreases the tension applied to the take-up core 10. In that manner, the tension in the ribbon is automatically adjusted for the diameters of the ribbon on the respective cores.

A photoelectric cell 34 carried by a mounting 35 is arranged to detect one edge of the ribbon R as it is fed through the machine and provide a signal to a control mechanism to maintain the alignment of the ribbon as it passes through the machine.

More specifically, photoelectric cell 34 receives light from a light source, not shown, through a slit 35*a* in the mounting 35. The photocell controls a series of relays which in turn control the direction of rotation of electric gear motor 18. The arm 4*c* attached to the output shaft of this motor is thereby displaced and, since its free end is closely located in the gap between the collars 4*b*, this displacement causes axial movement of the shaft 4 in bearing block 16. This provides lateral or axial control over chucks 11 between which the core 5 is held under the force of spring 15. The direction of this lateral control is determined by the position of the edge of the ribbon R adjacent the slit 35*a* in the mounting 35. If the lateral control is such that the edge of the ribbon covers the slit, light is cut off from photoelectric cell 34 and it switches the relays to reverse the direction of rotation of the gear motor 18. The arm 4*c* is then moved in the opposite direction and hence shaft 4 is axially displaced to move the core 5 so that the edge of the ribbon uncovers the slit to again allow light to reach the photocell 34. The system now reverses thereby providing constant correction to maintain the alignment of the ribbon as it passes through the machine. The constant correction previously noted is due to the fact that the edge detection means controls the direction of movement of the shaft 4 with the motor being activated at all times. This minimizes the time from the detection of the edges movement to actual adjustment of the equipment. A motor speed control is provided to compensate for different machine speeds and types and conditions of ribbon being handled.

Means are also provided to automatically shut off the machine at the completion of the re-inking of a ribbon by increased tension on the ribbon when the end of the roll is reached. The torque required to achieve this is adjustable and also operates to detect loose or detective attachment of the ribbon on the core. This arrangement will now be described in conjunction with the throw-off arrangement for the rollers.

The throw-off arrangement for the rollers 6 and 8 is illustrated diagrammatically in FIG. 3. This arrangement comprises an electric motor 36 whose output shaft drives an arm 37 which is connected to the swing arms 38 and 39 carrying rollers 6 and 8 respectively. Once the ribbon has been threaded on the machine, the rollers 6 and 8 are moved into the running position, shown in full line in FIG. 1, by rotation of the electric motor and the arm 37 on which the swing arms are mounted.

In the running position, rollers 6 and 8 deflect the ribbon in its passage through the machine and are held in this position by an adjustable torque control 40 on motor 36 until the ribbon is completely unwound from the core 5. At this point the tension of the ribbon R on rollers 6 and 8 increases and causes the torque control 40 to break loose, thus rotating the swing arms 38, 39 to throw off the rollers 6 and 8 towards the threading position (shown by the dashed lines) and thereby creating slack in the ribbon. The main drive motor 24 is energized through a limit switch which is only closed when the rollers 6 and 8 are in the running position. The main drive motor will thus stop as soon as torque control 40 breaks away and the slack created by this allows the ribbon to stop without pulling away from core 10. If the ribbon attachment to core 5 is defective, the ribbon will pull away from the core. However, the ribbon can then be easily re-anchored to the core to prevent it from coming loose and causing problems during its subsequent use in a printing apparatus.

It will be noted that both sides of the ribbon are re-inked under pressure with a relatively large arc of the ribbon in contact with a pre-metered layer of ink on the surface of the transfer rollers *7d, 7g* on both sides of the ribbon. The pressure between these rollers impregnates the ink into the interstices of the fibers and is arranged to be adjustable. Moreover, the inking station 7 provides for accurate metering of the ink by the metering rollers *7h, 7j* associated with each ink trough *7b, 7f*.

The heating elements associated with each of the heated rollers 6, 8 allow the temperature of the rollers to be adjusted within the range 100° to 300° F.

A fluorescent lamp 41 mounted in a reflector 42 transverse to the path of the ribbon R is arranged to shine light through the processed ribbon between roller 8 and core 13 so that the re-inked ribbon can be visually inspected by an operator viewing the ribbon from the other side.

It will be seen that the present invention provides a method and apparatus wherein re-inking of a ribbon can be accomplished from the front of the machine with all adjustments within easy reach. Furthermore, the ink reservoirs are large and have automatic ink level control re-circulation to cool and filter the ink. When not in use the inking rollers are easily separable to prevent spots occurring on the rollers and the rollers and ink pans can be easily removed for cleaning or replacement.

If desired, the transfer roller *7g* can be made adjustable so that it does not apply ink to the ribbon, but is only inked on one side by the lower transfer roller *7d*. Such an arrangement may be preferred for the re-inking of light-weight ribbons.

Generally, the ribbons to be re-inked will be nylon ribbons. Ribbons of other materials, of course, may also be treated.

The method and apparatus of the invention may also be employed for initially inking fresh ribbons as well as for re-inking used ribbons as described herein.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A method of applying ink to a ribbon comprising the steps of:

(a) supplying said ribbon to be inked from a supply core;

(b) heating said ribbon on a first rotating heated roller;

(c) passing the heated ribbon between the nip of a pair of inking rollers while applying ink to said ribbon under pressure exerted on both sides of said ribbon by said inking rollers with at least one of said inking rollers being driven to advance said ribbon;

(d) heating the inked ribbon on a second rotating heated roller; and (e) collecting said inked ribbon on a driven take-up core.

2. The method of claim 1 wherein the step of applying ink to said ribbon under pressure includes applying ink to both sides of said ribbon with said inking rollers.

3. The method of claim 1 including the steps of: applying tension to the ribbon with said heated rollers by deflecting the path of said ribbon and retracting said heated rollers from contact with said ribbon when tension in the ribbon exceeds a predetermined amount.

4. The method of claim 3 including the step of interrupting the drive to said inking rollers when said heated rollers retract.

5. The method of claim 1 including the steps of: remotely monitoring the position of one edge of said ribbon at a position adjacent said supply core and moving said supply core axially in relation to the position of said edge to align said ribbon.

6. The method of claim 5 including the steps of:

(a) driving said take-up core with a first driven pulley rotating in the desired direction of rotation of said take-up core;

(b) contacting said first driven pulley, through friction material, with a second driven pulley rotating in a direction opposite said first driven pulley, said second driven pulley being driven by rotation of said supply core as said supply core is driven by removal of ribbon therefrom; and (c) forcing said second pulley into said friction material contacting said first pulley, thereby reducing the driving force applied to said take-up core and providing back tension to said supply core.

7. The method of claim 5 including the steps of:

(a) remotely monitoring one edge of said ribbon at a location adjacent said supply core; and (b) moving said supply core axially in response to the position of the monitored edge, movement of said supply core aligning said ribbon.

8. A method of re-inking a fabric computer ribbon comprising the steps of:

(a) supplying said ribbon to be inked from a supply core;
(b) heating said ribbon by contacting said ribbon with a first rotating heated roller;
(c) passing the heated ribbon between the nip of a pair of inking rollers while applying ink to both sides of said ribbon under pressure, said pressure being exerted on said ribbon by said inking rollers, with at least one of said inking rollers being driven to advance said ribbon;
(d) heating the inked ribbon by contacting the inked ribbon with a second rotating heated roller;
(e) applying a predetermined amount of tension to said ribbon with said heated rollers by deflecting the path of said ribbon with said heated rollers;
(f) collecting said ribbon on a driven takeup core; and
(g) driving said take-up core and applying a back tension to said supply core with the tension on said ribbon by both cores determined by the relationship between the diameters of the ribbon on said supply core and said take-up core.

9. An apparatus for applying ink to a ribbon comprising:
(a) a supply core having ribbon to be inked wound thereon;
(b) a rotatable shaft affixed to said supply core;
(c) an opposed pair of rollers for advancing said ribbon through said apparatus, at least one of said opposed rollers also applying ink to said ribbon under pressure as said ribbon passes through the nip of said opposed rollers;
(d) means for heating said ribbon prior to its passage between said opposed rollers;
(e) means for heating said ribbon subsequent to its passage between said opposed rollers;
(f) a take-up core on which said ribbon is wound after inking;
(g) means for driving said take-up core, the tension applied to said ribbon by said take-up core being determined by the relationship between the diameters of the ribbon on said supply core and said take-up core; and
(h) means for providing back tension on said supply core.

10. The apparatus of claim 9 wherein said means for heating said ribbon comprise heated rollers.

11. The apparatus of claim 10 wherein said heated rollers deflect said ribbon as it passes through said apparatus thereby applying tension to said ribbon, said apparatus further including means for retracting said heated rollers when tension on said ribbon exceeds a predetermined value.

12. The apparatus of claim 11 wherein said retracting means comprises:
(a) an elongated pivoting member, said heated rollers being rotationally affixed on each extremity of said pivoting member, rotation of said pivoting member in a first direction causing said heated rollers to deflect the passage of said ribbon through said apparatus, rotation of said pivoting member in a direction opposite said first direction causing said heated rollers to retract from contact with said ribbon; and
(b) means for inducing rotation of said pivoting member in said first direction at a controlled torque.

13. The apparatus of claim 12 wherein said rotation inducing means is an electric motor, said apparatus further including an adjustable torque control connecting said motor to said pivoting member.

14. The apparatus of claim 12 including means for interrupting drive to said opposed rollers when said heated rollers are retracted from said ribbon.

15. The apparatus of claim 9 wherein the means for driving the take-up core comprises:
(a) a first shaft affixed to said take-up core;
(b) a first pulley affixed to drive said first shaft;
(c) a main drive for driving said first pulley in a direction winding said ribbon on said take-up core;
(d) a second shaft affixed to said supply cover, said second shaft being driven by removal of ribbon from said supply core;
(e) a second pulley rotationally mounted on said first shaft, said second pulley being driven by said second shaft in a direction opposite said first pulley;
(f) means for transmitting the rotation of said second pulley to said first pulley to control the tension exerted on said ribbon by said take-up core.

16. The apparatus of claim 15 wherein said first pulley and said second pulley are adjacent one another on said first shaft, said apparatus further including friction material disposed between said pulleys and a spring forcing said second pulley toward said first pulley.

17. The apparatus of claim 16 where the length of said spring can be adjusted to alter the force exerted against said second pulley.

18. The apparatus of claim 15 wherein said apparatus includes: a drive roller, said drive roller contacting and driving one of said opposed rollers advancing said ribbon through said apparatus; a motor driving said drive roller, a drive shaft about which said drive roller rotates; a main drive pulley affixed on said drive shaft and means for transmitting the rotation of said main drive pulley to said first pulley while reversing the direction of rotation between said main drive pulley and said first pulley.

19. The apparatus of claim 9, including means for remotely detecting one edge of said ribbon at a position adjacent said supply core and means for moving said supply core axially in relation to the position of said edge.

20. The apparatus of claim 19 wherein said rotatable shaft is mounted in said apparatus on bearings allowing axial movement of said rotatable shaft, a photocell detector monitoring the presence or absence of said ribbon at a location adjacent said supply core, an electric motor receiving input from said detector, said motor rotating one direction when said detector detects said ribbon and the opposite direction when said detector detects the absence of said ribbon, means connected to said motor and said rotatable shaft for converting rotation of said motor to axial movement of said rotatable shaft, the direction of said axial movement being in relatio,n to the direction of rotation of said motor.

* * * * *

UNITED STATES PATENT OFFICE

CERTIFICATE OF CORRECTION

Patent No. 4,128,348 Dated December 5, 1978

Inventor(s) BAZIL E. STEELE and PAUL O. MICHEEL

It is certified that error appears in the above-identified patent and that said Letters Patent are hereby corrected as shown below:

In claim 15, col. 8, line 18, delete "supply cover" and insert therefor --supply core--; and In claim 20, col. 8, line 62, delete "relatio,n" and insert therefor --relation--.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*